US006699055B2

(12) United States Patent
Peng et al.

(10) Patent No.: US 6,699,055 B2
(45) Date of Patent: Mar. 2, 2004

(54) ELECTRICAL CONNECTOR WITH TERMINAL INSERTION GUIDE MECHANISMS

(75) Inventors: Fu Jin Peng, Kunshan (CN); Nick Lin, Tu-Chen (TW); Ren-Chih Li, Tu-Chen (TW); Jian Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/286,051

(22) Filed: Nov. 1, 2002

(65) Prior Publication Data

US 2003/0232529 A1 Dec. 18, 2003

(30) Foreign Application Priority Data

Jun. 13, 2002 (TW) ..... 91208814

(51) Int. Cl.[7] ..... H01R 4/50

(52) U.S. Cl. ..... 439/342; 439/733.1

(58) Field of Search ..... 439/259, 342, 439/444, 682, 869, 733.1

(56) References Cited

U.S. PATENT DOCUMENTS 4,726,777 A * 2/1988 Billman et al. ..... 439/70
5,466,169 A * 11/1995 Lai ..... 439/264
5,609,495 A * 3/1997 McHugh ..... 439/268
6,328,587 B1 * 12/2001 Hsu ..... 439/342

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

An electrical connector (1) includes: an insulative base (10) having a top surface (104), a bottom surface (103), and a plurality of passageways (101); a cover (12) slidably mounted on the base; a plurality of conductive terminals (16) received in the passageways; and an actuating device (14). Each passageway is bounded by two opposite first walls (1018), two opposite second walls (1019), and a bottom wall (1013). Each first wall defines a through slot (1011), and one of the second walls forms a slanted guiding portion (1012) spanning from the top surface to adjacent the bottom wall. The bottom wall forms a chamfer portion (1014). The guiding portion and the chamfer portion cooperate to protect the corresponding terminal and the base from damage when the terminal is inserted into the passageway.

5 Claims, 4 Drawing Sheets

ELECTRICAL CONNECTOR WITH TERMINAL INSERTION GUIDE MECHANISMS

BACKGROUND OF THE INVENTION

1. Field of the Invention

The present invention relates to an electrical connector for electrically interconnecting an electrical package such as a central processing unit (CPU) with a circuit substrate such as a printed circuit board (PCB), and particularly to an electrical connector with terminal guide mechanisms that facilitate assembly of the electrical connector.

2. Description of Related Art

Socket connectors are widely used in personal computers (PCs) to electrically interconnect CPUs with PCBs. A conventional socket connector is disclosed in "PGA SOCKETS" (Connector Specifier Magazine, February 2000) and U.S. Pat. Nos. 6,132,222, 6,116,923 and 5,609,495. The socket connector comprises an insulative base, a cover slidably attached on the base, an actuating device assembled with the base and the cover, and a multiplicity of conductive terminals retained in the base. The base comprises a multiplicity of passageways extending from a top surface to a bottom surface thereof, for receiving the terminals. Each terminal comprises a contact portion located adjacent the top surface of the base and adapted to electrically engage with leads of the CPU, and a soldering portion located adjacent the bottom surface of the base and adapted to be soldered to the PCB. Typically, each passageway has a relatively large opening at the bottom surface of the base. When the terminal is received in the passageway, the soldering portion of the terminal occupies the opening. However, a gap still remains between the soldering portion and the bottom surface of the base. When the soldering portion is soldered to the PCB, solder is prone to enter the gap and wick from the soldering portion to the contact portion of the terminal. Such "soldering wicking" can seriously degrade the electrical connection between the CPU leads and the contact portion of the terminal, and can even result in failure of the electrical connection between the CPU and the PCB.

China Pat. No. ZL99239496.1 discloses a socket connector having a base defining a multiplicity of passageways receiving a multiplicity of electrical terminals. Each passageway comprises a fastening recess to guide insertion of the corresponding terminal into the passageway. A width of the fastening recess is about the same as a width of the terminal. However, the terminals cannot always be accurately inserted into the passageways. For example, a terminal may inserted at an oblique angle relative to the fastening recess. A distal end of the terminal may strike a wall of the base at the passageway. This can result in deformation of the terminal and damage to the base.

In view of the above, a new electrical connector that overcomes the above-mentioned disadvantages is desired.

SUMMARY OF THE INVENTION

An object of the present invention is to provide an electrical connector having a guide mechanisms that protect the terminals and a base of the connector from damage when the terminals are inserted into passageways of the connector.

In order to achieve the above object, an electrical connector of the present invention is for electrically connecting a CPU and a PCB. The electrical connector comprises: an insulative base having a top surface and a bottom surface, and defining a multiplicity of passageways; a cover slidably mounted on the top surface; a multiplicity of terminals received in the passageways; and an actuating device assembled with the cover and base. Each passageway is bounded by two opposite first walls, two opposite second walls interconnecting the first walls, and a bottom wall adjacent the PCB. Each first wall defines a through slot, and one of the second walls forms a slanted guiding portion spanning from the top surface to adjacent the bottom wall. The bottom wall forms a chamfer portion at the passageway adjacent said one of the second walls. The guiding portion and the chamfer portion cooperate to ensure that when each terminal is inserting into a corresponding passageway, the terminal does not unduly rub the second walls or the bottom wall. This protects both the terminal and the base from damage.

Other objects, advantages and novel features of the present invention will be drawn from the following detailed description of a preferred embodiment of the present invention with attached drawings, in which:

DESCRIPTION OF THE PREFERRED EMBODIMENT

Reference will now be made to the drawings to describe the present invention in detail.

Figure 1:
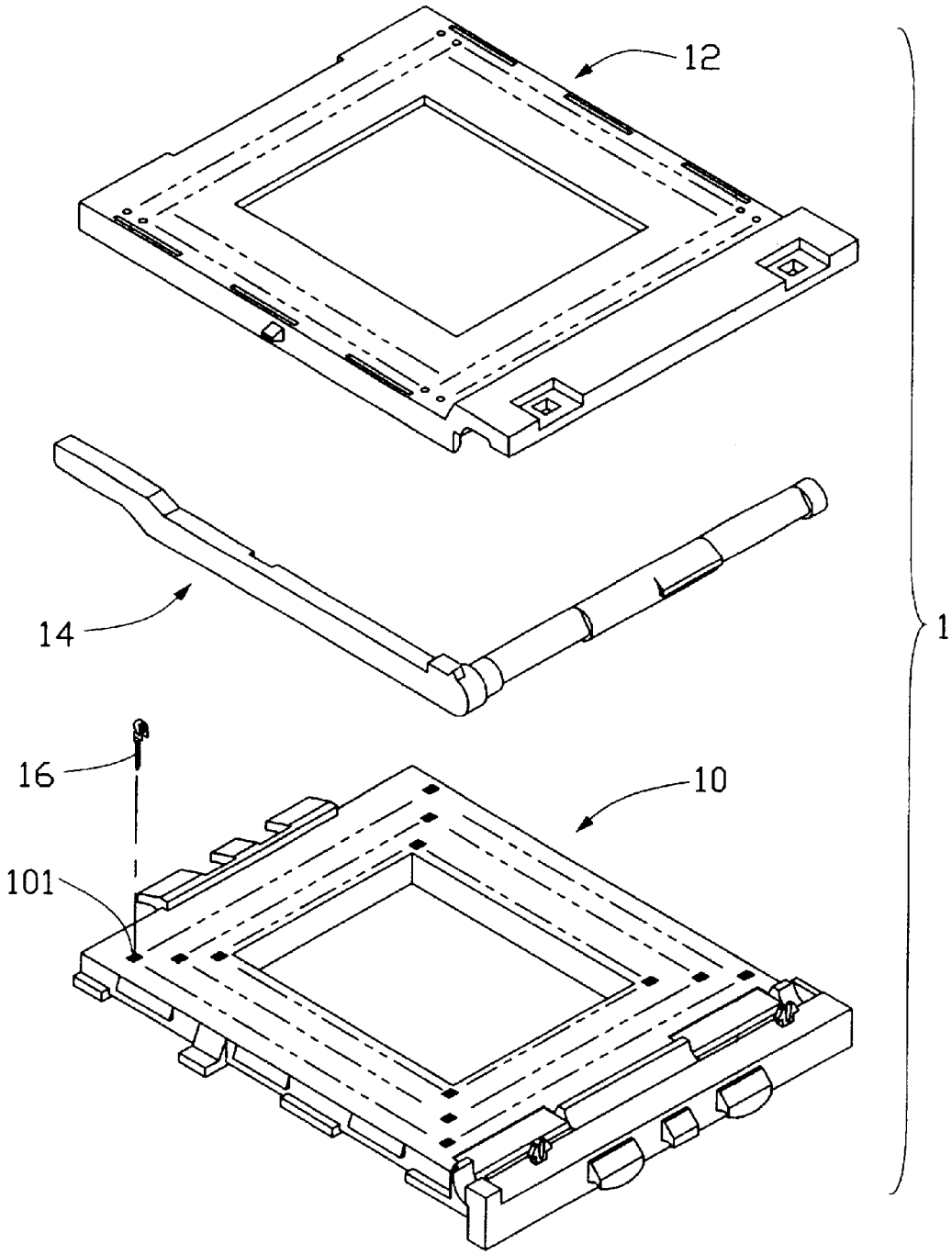
FIG. 1 is an exploded, isometric and simplified view of an electrical connector in accordance with a preferred embodiment of the present invention.
Figure 3:
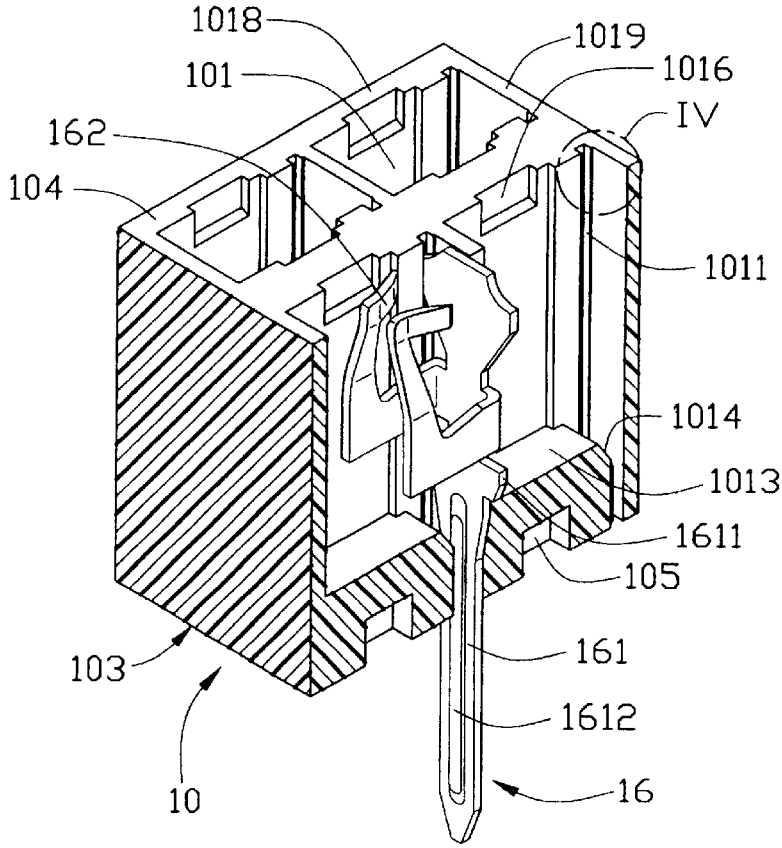
FIG. 3 is an enlarged, isometric cut-away view of part of the electrical connector of FIG. 1, showing one terminal inserted into one passageway of the connector.

Referring to FIGS. 1 and 3, a socket connector 1 in accordance with the present invention is for electrically connecting a CPU (not shown) and a PCB (not shown). The socket connector 1 comprises an insulative base 10, a cover 12 slidably mounted on the base 10, an actuating device 14 assembled with the cover 12 and base 10, and a multiplicity of conductive terminals 16 respectively received in a multiplicity of passageways 101 defined in the base 10.

Figure 2:
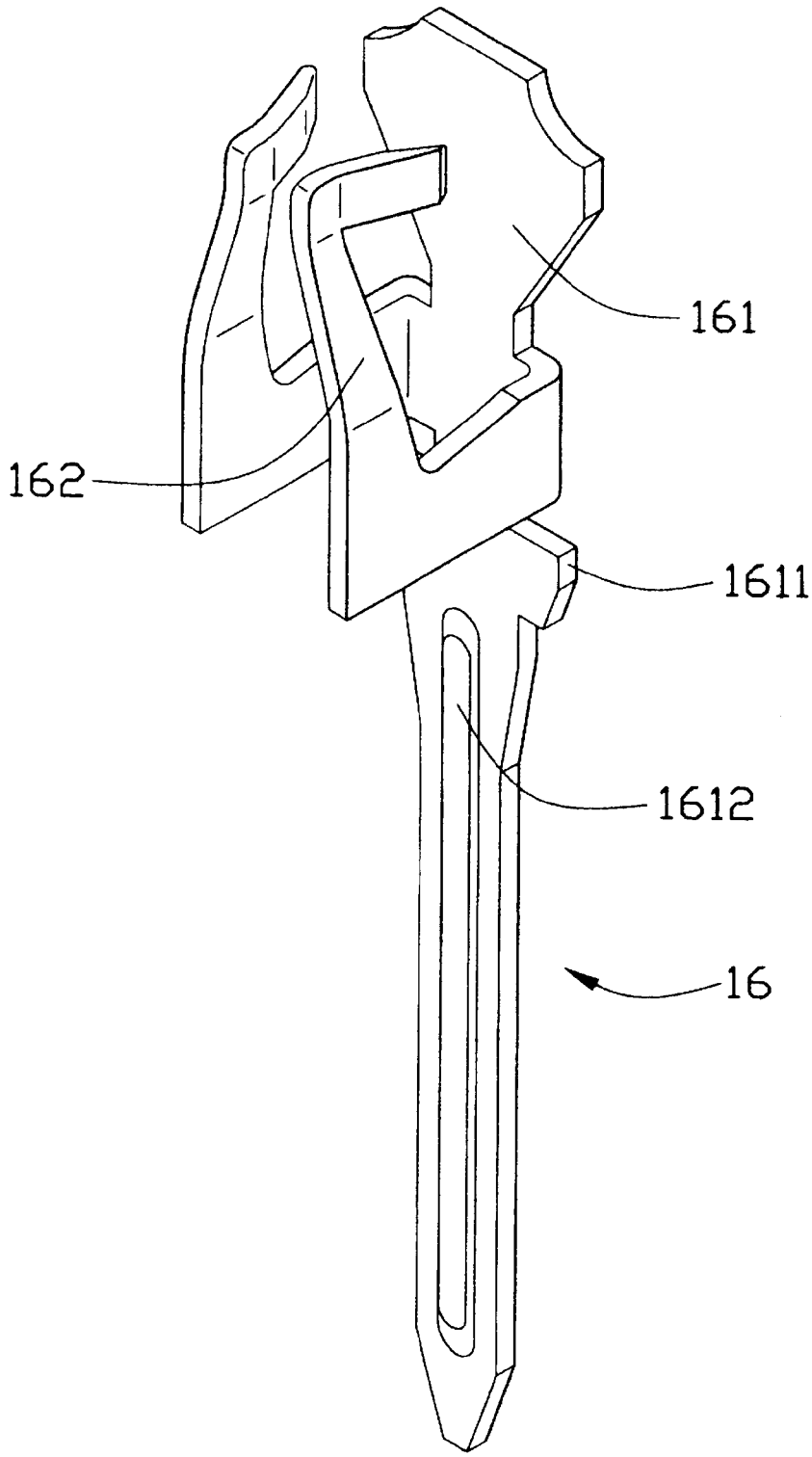
FIG. 2 is an enlarged, isometric view of one terminal of the electrical connector of FIG. 1, viewed from another aspect.

Referring particularly to FIG. 2, each terminal 16 comprises an elongate retention portion 161, and a pair of resilient contact portions 162 extending from the opposite sides respectively of an upper part of the retention portion 161. A pair of barbs 1611 is respectively formed at the opposite sides of the upper part of the retention portion 161, for interferentially securing the terminal 16 in a corresponding passageway 101 of the base 10. An elongate rib 1612 is formed on a main face of the retention portion 161, below the barbs 1611.

Figure 4:
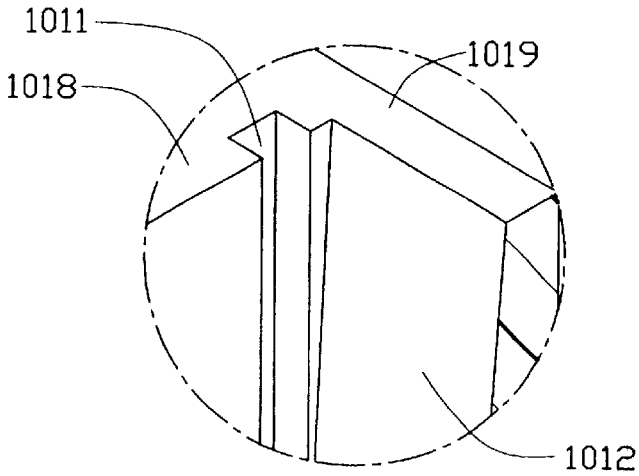
FIG. 4 is an enlarged view of a circled portion IV of FIG. 3.
Figure 5:
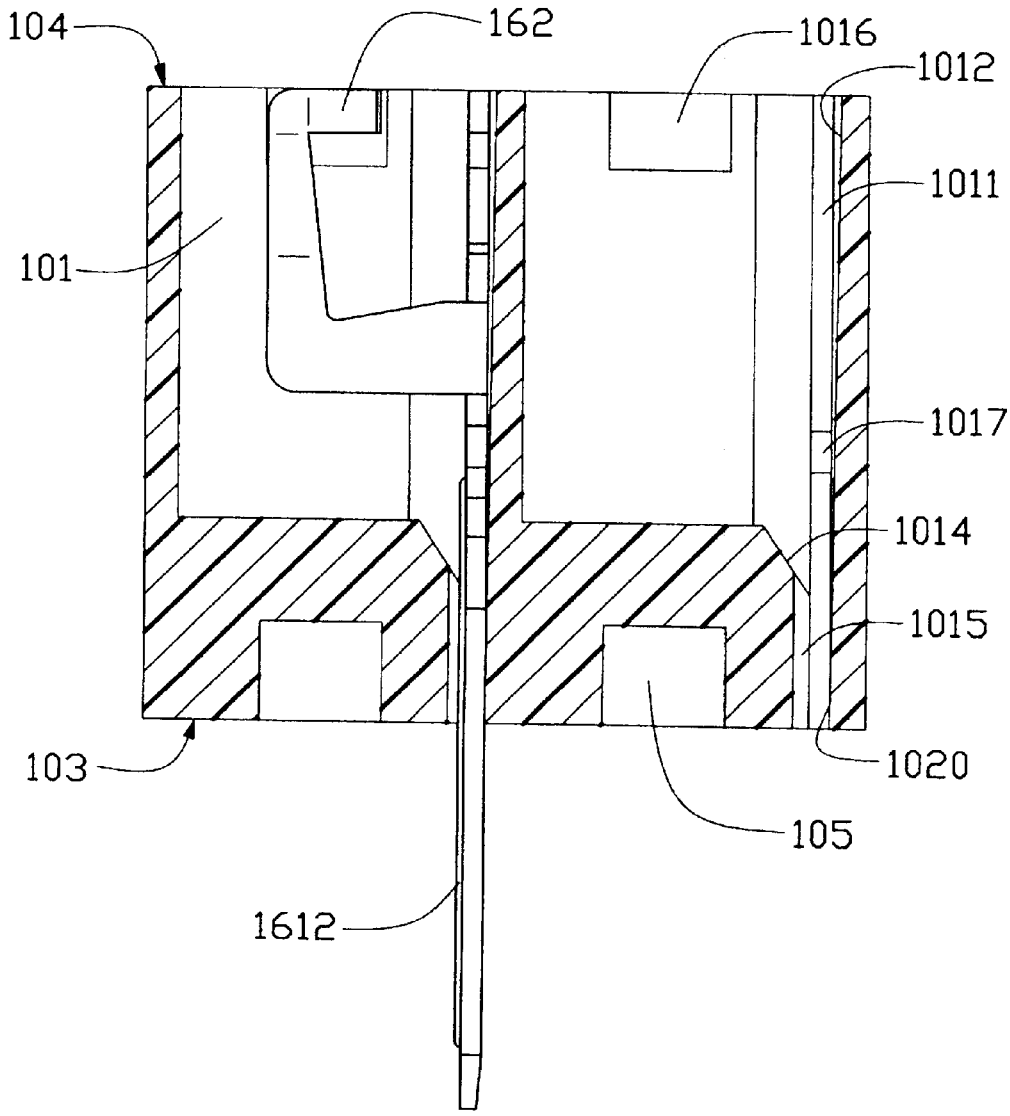
FIG. 5 is a side plan view of FIG. 3.

Referring also to FIGS. 4 and 5, the base 10 comprises a bottom surface 103 and a top surface 104. The bottom surface 103 is supported on the PCB, and the top surface 104 is engaged with the cover 12. Each passageway 101 of the base 10 is bounded by two opposite first walls 1018, two opposite second walls 1019 interconnecting the first walls 1018, and a bottom wall 1013 interconnecting the first walls 1018 adjacent the PCB. Each first wall 1018 defines a through slot 10 11 adjacent one of the second walls 1019, the through slot 1011 spanning from the top surface 104 to the bottom surface 103. Each through slot 1011 comprises a securing recess 1017 for receiving a corresponding barb 1611 of a corresponding terminal 16. Each first wall 1018 also defines a receiving recess 1016, for receiving a corresponding contact portion 162 of the terminal 16. The bottom wall 1013 defines an opening (not labeled) adjacent said one of the second walls 1019, for insertion of the terminal 16 therethrough. A blind hole 105 is defined in the bottom wall 1013 at the bottom surface 103, for preventing the base 10 from deforming when the base 10 is subjected to high temperatures during soldering of the socket connector 1 to the PCB.

Said one of the second walls 1019 forms a slanted guiding portion 1012 spanning from the top surface 104 to adjacent the bottom wall 1013. The guiding portion 1012 is located generally between the through slots 1011. The bottom wall 1013 forms a chamfer portion 1014 at the passageway 101 adjacent said one of the second walls 1019. The chamfer portion 1014 is located generally between the through slots 1011. A receiving slot 1015 is defined in a face of the bottom wall 1013 that opposes said one of the second walls 1019. Said one of the second walls 1019 has a supporting surface 1020 connecting between the guiding portion 1012 and the bottom surface 103. The supporting surface 1020 is perpendicular to the bottom surface 103.

In assembly, the retention portion 161 of each terminal 16 is inserted into the corresponding passageway 101 at the through slots 1011. The rib 1612 of the terminal 16 slides along the receiving slot 1015. The barbs 1612 of the terminal 16 interferentially engage in the securing recesses 1017, and the resilient contact portions 162 of the terminal 16 are received in the receiving recesses 1016. The guiding portion 1012 and the chamfer portion 1014 cooperate to ensure that when the terminal 16 is inserted into the passageway 101, the terminal 16 does not unduly rub the second walls 1019 or the bottom wall 1013. This protects both the terminal 16 and the base 10 from damage.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical connector for electrically connecting an electronic package with a circuit substrate, the electrical connector comprising:

an insulative base comprising a bottom surface, a top surface, and a plurality of passageways receiving a plurality of conductive terminals therein;

a cover slidably mounting on the base and adapted to support the electronic package thereon; and a plurality of guide mechanisms provided at the passageways to facilitate insertion of the terminals thereinto, each of the guide mechanisms comprising a slanted guiding portion and a chamfer portion;

wherein each of the passageways is bounded by two first walls opposite to each other, a second wall and a bottom wall; each of said first walls defining a through slot that spans from the top surface to the bottom surface; the slanted guiding portion being provided at the second wall, being spanned from the top surface to the bottom wall and being located generally between through slots of the two first walls; and the chamfer portion being provided at the bottom wall which is adjacent to the second wall; the base at each of the passageways comprising a supporting surface which connects between the slanted guiding portion and bottom surface;

wherein each of the plurality of terminals including a planar retention portion abutting against the slanted guiding portion, two opposite barbs interferentially receiving in a corresponding securing recess of the through slots; a resilient contact portion receiving in a corresponding receiving recess of each of the two first walls; and an elongate rib arranging at one face of a tail portion and sliding along a receiving slot.

2. The electrical connector as described in claim 1, wherein the chamfer portion is located generally between the two through slots.

3. The electrical connector as described in claim 1, wherein a receiving slot is defined in a face of the bottom wall that opposes the second wall.

4. The electrical connector as described in claim 1, wherein the supporting surface is substantially perpendicular to the bottom surface.

5. The electrical connector as described in claim 1, wherein a blind hole is defined in the bottom wall at the bottom surface at each of the passageways.

* * * * *